US009434184B2

(12) United States Patent
Hashizume et al.

(10) Patent No.: US 9,434,184 B2
(45) Date of Patent: Sep. 6, 2016

(54) PAPER FEED DEVICE FOR IMAGE FORMING APPARATUS

(71) Applicant: RISO KAGAKU CORPORATION, Tokyo (JP)

(72) Inventors: Teruaki Hashizume, Ibaraki (JP); Kentaro Tatsumi, Ibaraki (JP)

(73) Assignee: RISO KAGAKU CORPORATION, Tokyo (JP)

( * ) Notice: Subject to any disclaimer, the term of this patent is extended or adjusted under 35 U.S.C. 154(b) by 0 days.

(21) Appl. No.: 15/001,412

(22) Filed: Jan. 20, 2016

(65) Prior Publication Data

US 2016/0214407 A1 Jul. 28, 2016

(30) Foreign Application Priority Data

Jan. 26, 2015 (JP) ..... 2015-011990
Aug. 21, 2015 (JP) ..... 2015-163358

(51) Int. Cl.
*B41J 2/14* (2006.01)
*B41J 11/00* (2006.01)

(52) U.S. Cl.
CPC ..... *B41J 11/0045* (2013.01)

(58) Field of Classification Search
CPC .... B41J 11/0085; B41J 11/002; B41J 15/04; B41J 11/42
See application file for complete search history.

(56) References Cited

U.S. PATENT DOCUMENTS 7,469,999 B2 * 12/2008 Kadomatsu ..... B41J 11/002 347/102
8,840,213 B2 * 9/2014 Imamura ..... B41J 11/0085 347/104

FOREIGN PATENT DOCUMENTS

JP 3129922 2/2007

* cited by examiner

*Primary Examiner* — Lamson Nguyen
(74) *Attorney, Agent, or Firm* — Greenblum & Bernstein, P.L.C.

(57) ABSTRACT

A paper feed device is disposed near an opening formed on a housing of for an image forming apparatus. The paper feed device includes a paper feed tray on which papers can be stacked, upper and lower guide plates disposed on a downstream side from the opening to form a paper transfer path therebetween, a drive shaft extended along a paper width direction perpendicular to the paper transfer direction, a paper feed roller attached to the drive shaft for feeding out a paper from the paper feed tray to the paper feed path, and a pair of elastic rollers coaxially attached to the drive shaft on either side of the paper feed roller. The pair of elastic rollers covers a space between the upper and lower guide plates. Each diameter of the elastic rollers is made slightly smaller than a diameter of the paper feed roller.

7 Claims, 8 Drawing Sheets

PAPER FEED DEVICE FOR IMAGE FORMING APPARATUS

BACKGROUND OF THE INVENTION

1. Technical Field

The present invention relates to a paper feed device for an image forming apparatus that is disposed near an opening formed on a housing of the image forming apparatus.

2. Background Arts

A Patent Document 1 (Japanese Registered Utility Model No. 3129922) discloses a paper feed device that can prevent a paper jam.

The paper feed device disclosed in the Patent Document 1 is provided with a paper feed tray on which papers can be set from above. A transfer frame is fixedly provided along a downstream edge of the paper feed tray, and is provided with an opening opened toward an outside. The transfer frame is attached to a housing of an image forming apparatus, or is configured integrally with the housing.

In addition, a scraper roller is provided rotatably above the downstream edge of the paper feed tray. A drive shaft coupled with a drive motor is provided on a downstream side from the scraper rollers, and above a transfer start position of the transfer frame. The drive shaft extends longitudinally in a paper width direction, and is rotatable in a direction for feeding papers forward.

Further, a pick-up roller is attached to almost the center of the drive shaft along its longitudinal direction, and paper receive rollers having rigidity are also attached to the drive shaft on either side of the pick-up roller.

Here, a rotational force of the drive shaft rotated integrally with the pick-up roller is transferred to a shaft of the scraper roller via a gear mechanism.

In addition, a separation plate is provided beneath the pick-up roller so as to be opposing to the pick-up roller.

Further, a pair of secondary paper feed rollers is provided on a downstream side from the transfer frame so as to be viewed through the opening formed on the transfer frame.

In the above paper feed device, some upper papers among papers stacked on the paper feed tray are drawn forward by the scraper roller, and then only an uppermost paper of them is separated from other papers of them by the pick-up roller and the separation plate disposed on a downstream side from the scraper roller. The separated uppermost paper is transferred to the secondary feed rollers disposed on a downstream side from the transfer frame, and then the paper is transferred forward to an image forming unit of the image forming apparatus. Subsequently, images are formed on the paper transferred to the image forming unit.

During these processes, the paper receive rollers that have rigidity and are provided coaxially on either side of the pick-up roller attached to the drive shaft hold a warped paper and feed the paper forward together with the pick-up roller. Therefore, a warped paper can be prevented from jamming.

SUMMARY OF THE INVENTION

In the image forming apparatus provided with the above paper feed device disclosed in the Patent Document 1, the transfer frame fixedly provided on a downstream side from the paper feed tray is provided with the opening exposed to an outside. Therefore, noises generated in the apparatus inevitably leak out through the opening formed on the transfer frame.

Quietness (noises reduction) is desired for an image forming apparatus. Therefore, in order to improve noise-reduction performance, the opening formed on the transfer frame may be made substantially narrowed by forming the pair of paper receive rollers long along the drive shaft to have a cylindrical shape. It is not difficult to expand the paper receive rollers along the drive shaft by making the paper receive rollers from resin.

However, in a case where the paper receive rollers are formed to have a long cylindrical shape, spaces formed around the paper receive rollers having rigidity are reduced. As a result, it may become difficult to remove a jammed paper.

An object to the present invention is to provide a paper feed device for an image forming apparatus that can improve quietness performance, and can bring superior jammed-paper removal performance and superior paper-feed performance.

An aspect of the present invention provides a paper feed device for an image forming apparatus that is disposed near an opening formed on a portion of a housing of the apparatus, the device comprising: a paper feed tray on which papers can be stacked; an upper guide plate and a lower guide plate that are disposed at a border between the opening and an inside of the housing, and forms a paper transfer path therebetween; a drive shaft that is disposed on an upstream side from the upper guide plate and the lower guide plate so as to extends along a paper width direction perpendicular to the paper transfer direction, and is rotated, by a drive source therefor, in a rotational direction for feeding the papers; a paper feed roller that is attached to the drive shaft, and separates a paper from the papers stacked on the paper feed tray to feed the paper to the paper feed path formed between the upper guide plate and the lower guide plate; and a pair of elastic rollers that are attached to the drive shaft on either side of the paper feed roller coaxially with the paper feed roller, and formed long so as to cover a space between the upper guide plate and the lower guide plate, wherein each diameter of the elastic rollers is made slightly smaller than a diameter of the paper feed roller.

According to the aspect, noises generated in the housing can be prevented from leaking out from the opening through the space formed between the upper guide plate and the lower guide plate by covering the space by use of the pair of elastic rollers. Therefore, quietness (noise reduction) performance of the image forming apparatus 1 can be improved.

In addition, the pair of elastic rollers can function as paper pressing rollers that flatten a warped paper. Therefore, paper feed performance can be improved Further, the pair of elastic rollers has elastic deformability. Therefore, the elastic rollers bring superior jammed-paper removability for easily removing a jammed paper from any cause when feeding papers due to some reason. When removing the jammed paper, a user or a service person can easily deform the elastic rollers by his/her fingers, and thereby can remove the jammed paper easily.

It is preferable that each of the elastic rollers is made from elastically deformable foamed material.

According to this configuration, the elastic rollers can absorb the noises due to noise absorption characteristics of the elastically deformable porous foamed material having an open-cell structure.

Here, it is preferable that each of the elastic rollers is formed as a sponge roller made from the foamed material, a paper pressing roller that has a diameter almost equal to a diameter of the sponge roller and has rigidity for flattening a warped paper is attached to the sponge roller, and the paper pressing roller is slidable on an outer circumferential surface of the sponge roller that is elastically deformable.

According to this configuration, the paper pressing roller having a diameter almost equal to a diameter of the sponge roller and having rigidity for flattening is slidably attached on the outer circumferential surface. Therefore, a warped thick paper can be flattened surely according to its paper size, even if a width of papers in a paper width direction varies.

Alternatively, it is preferable that each of the elastic rollers is formed as a cloth-wrapped elastic roller that includes a pair of ring-shaped circular plates that is distanced on the drive shaft, a compression spring that is interposed between the pair of ring-shaped circular plates, and a hollow cylindrical cloth member that is formed long in the in an axial direction of the drive shaft to cover the pair of ring-shaped circular plates and the compression spring.

According to this configuration, the quietness (noise reduction) performance, the paper feed performance, and the jammed-paper removability can be improved adequately.

It is preferable that the cloth-wrapped elastic roller is disposed in a plurality on either side of the paper feed roller coaxially with the drive shaft, a paper pressing roller that has a diameter almost equal to a diameter of the cloth-wrapped elastic roller and has rigidity for flattening a warped paper is interposed between the plurality of cloth-wrapped elastic roller on either side of the paper feed roller.

According to this configuration, the paper pressing roller is interposed between the plurality of cloth-wrapped elastic roller on either side of the paper feed roller. Therefore, a warped thick paper can be flattened surely according to its paper size, even if a width of papers in a paper width direction varies.

It is preferable that the paper feed device further comprises a hot-air blower that blows hot air warmed by exhaust heat generated in the image forming apparatus onto the elastic rollers.

According to this configuration, hot air is blown onto the elastic rollers made from the foamed material by the hot-air blower that utilizes exhaust heat generated in the image forming apparatus. Therefore, the elastic rollers (sponge rollers) can be prevented from hardening, and can maintain its quietness (noise reduction) performance stably. Especially in winter when a room temperature is low, the hardening prevention performance can be brought prominently.

It is preferable that the paper feed roller includes a scraper roller that is disposed parallel to the drive shaft to be rotatably, and draw forward some upper papers from the papers stacked on the paper feed tray, and a pick-up roller that is attached to the drive shaft, and separate an uppermost paper from the upper papers drawn by the scraper roller to feed the uppermost paper to the paper transfer path formed between the upper guide plate and the lower guide plate, wherein the pair of elastic rollers is attached to the drive shaft on either side of the pick-up roller coaxially with the pick-up roller, and each diameter of the elastic rollers is made slightly smaller than a diameter of the pick-up roller.

DESCRIPTION OF THE EMBODIMENTS

Hereinafter, a paper feed device for an image forming apparatus according to embodiments will be described with reference to the drawings.

Then paper feed device according to the embodiments can be applied to an image forming apparatus that is an inkjet type, a stencil type, an electronic photography type or the like, and the image forming apparatus will be described with reference to FIG. 1.

(Image Forming Apparatus 1)

Figure 1:
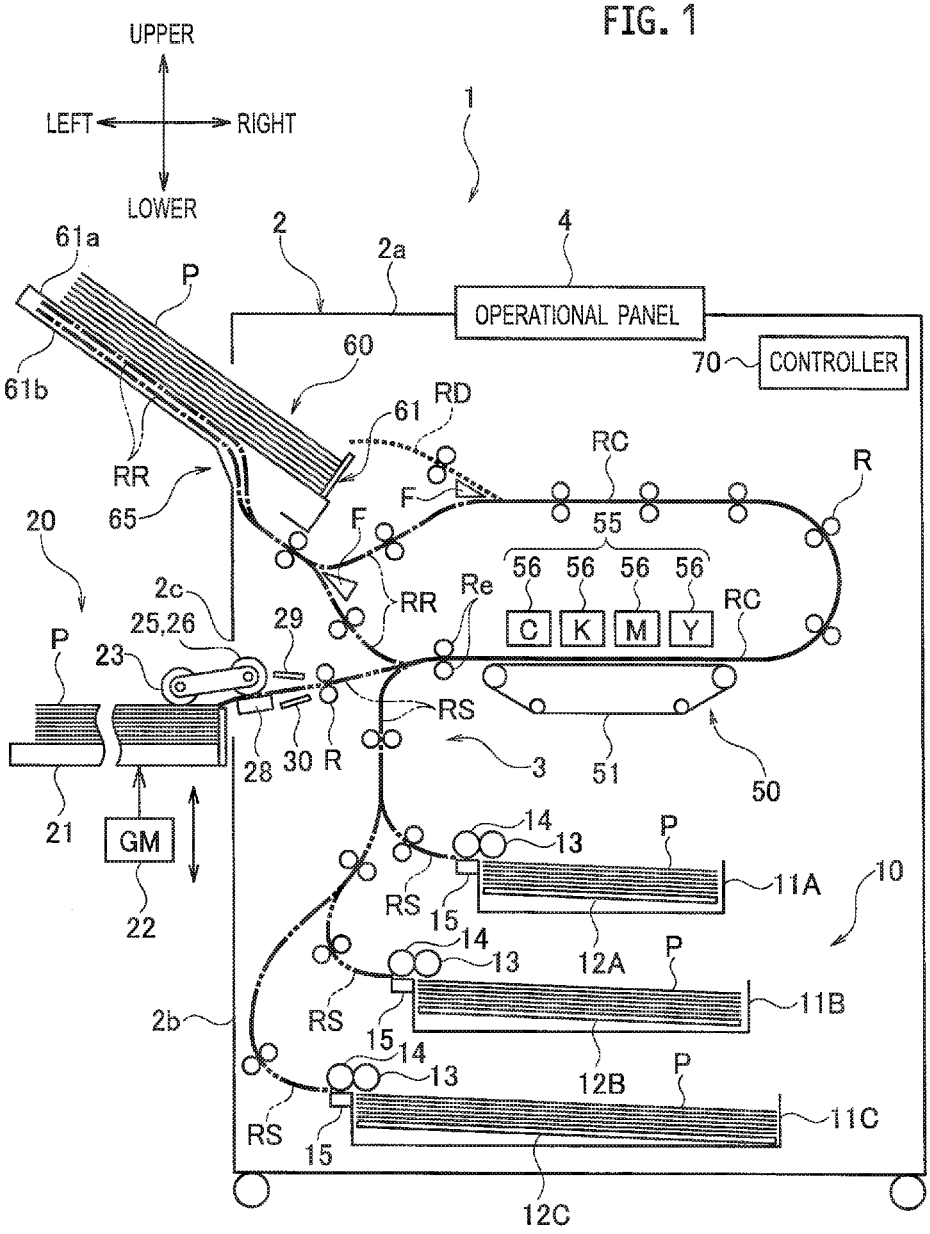
FIG. 1 is a configurational diagram of an image forming apparatus provided with a paper feed device according to an embodiment.

Here, "upper", "lower", "left" and "right" are defined, as shown in FIG. 1 for descriptions to be made below.

As shown in FIG. 1, a housing 2 of the image forming apparatus 1 has an almost box shape and brings an appearance of the image forming apparatus 1. The image forming apparatus 1 is configured to print images on papers P in the housing 2 by using inks in an inkjet method.

The image forming apparatus 1 includes a paper transfer section 3, an operational panel 4, an internal paper feeder 10, an outer paper feeder 20, a platen belt section 50, an inkjet print unit 55, a paper ejector 60, a paper switchback section 65, and a controller 70.

The paper transfer section 3 function to transfer papers P in the housing 2. The paper transfer section 3 includes paper feed paths RS indicated by dashed two-dotted lines, a normal path RC indicated by a solid line, a paper ejection path RD indicated by a dotted line, and switchback paths RR indicated by dashed one-dotted lines. The switchback paths RR are used in duplicate printing. In following descriptions, terms "upstream" and "downstream" mean upstream and downstream along a transfer direction of papers P.

The normal path RC formed around the inkjet print unit 55 and the switchback paths RR form a loop transfer path, and the paper feed paths RS are connected to the loop path.

On the paper transfer section 3, plural pairs of paper transfer rollers R for transferring papers P, and plural flappers F for switching over transfer directions TD of papers P are provided at their positions as shown in FIG. 1.

The operational panel 4 is disposed near a top panel 2*a* of the housing 2. The operational panel 4 is provided with various buttons for executing print jobs, a numeric keypad, a display panel and so on.

The internal paper feeder 10 that feeds papers P in the housing 2 is disposed at a lower portion in the housing 2.

In the internal paper feeder 10, plural internal paper feed trays 11A, 11B and 11C prepared according to paper sizes are provided vertically as upper, middle and lower shelves, respectively. Each of the internal paper feed trays 11A, 11B and 11C can be drawn out to the front. Movable plates 12A, 12B and 12C made movable vertically by elevating means (not shown) are provided in the internal paper feed trays 11A, 11B and 11C, respectively. Papers P are stacked on the movable plates 12A, 12B and 12C with respect to paper sizes.

A scraper roller 13 is provided rotatably above each downstream end of the internal paper feed trays 11A, 11B and 11C in a paper transfer direction TD. The scraper roller 13 can be contacted-with and distanced-from an uppermost paper P of the papers P stacked on the internal paper feed tray 11A, 11B or 11C. A pick-up roller 14 is provided rotatably on a downstream side of the scraper roller 13. A separation plate 15 is provided beneath the pick-up roller 14 so as to be opposing to the pick-up roller 14.

One of the internal paper feed trays 11A, 11B and 11C is selected by a user's operation made through the operational panel 4, and then some upper papers P among the papers P stacked on the selected internal paper feed tray 11A, 11B or 11C are drawn forward by the scraper roller 13. Subsequently, only an uppermost paper P of them is separated from other papers P of them by the pick-up roller 14 and the separation plate 15 disposed on a downstream side of the scraper roller 13, and then the uppermost paper P is fed to the paper feed path RS disposed on a downstream side from the pick-up roller 14 and the separation plate 15.

The outer paper feeder 20 is disposed on an outside of the housing 2, and papers P can be set to the outer paper feeder 20 from above. The outer paper feeder 20 is the paper feed device according to the present embodiment. The outer paper feeder 20 is disposed near an opening 2*c* formed on a left-side panel 2*b* of the housing 2. The opening 2*c* is formed by opening a portion of the housing 2 toward the outside.

Figure 2:
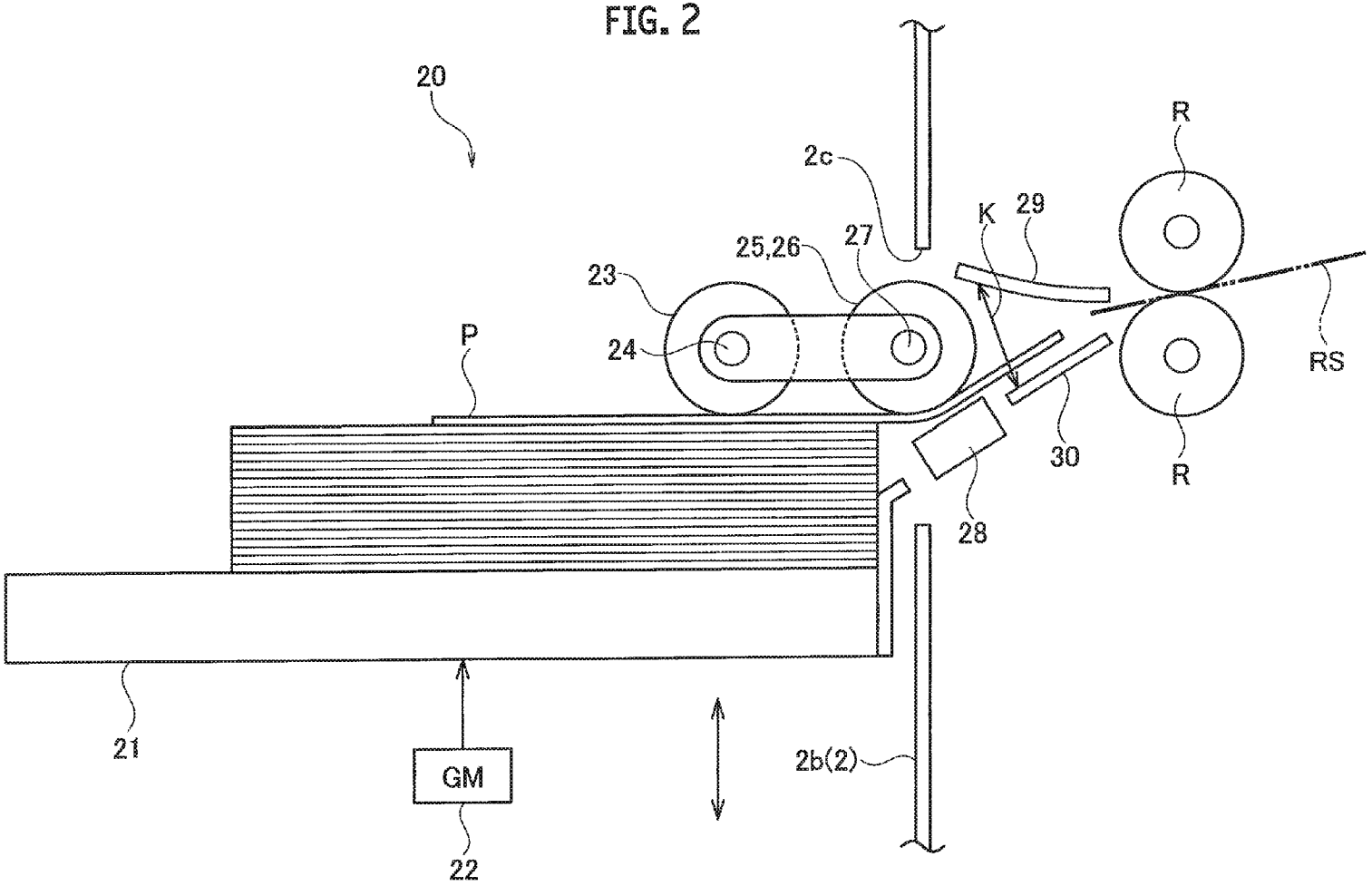
FIG. 2 is a front view of the paper feed device.

The outer paper feeder 20 is provided with a paper feed tray 21, and the paper feed tray 21 can be moved vertically along an outer lower portion of the left-side panel 2*b* of the housing 2 by a geared motor 22 as shown in FIGS. 1 and 2.

Papers P of one type selected among various paper sizes (from the minimum size [e.g. postcard size] to the maximum size [e.g. A3 size]) are stacked on the paper feed tray 21, and the size of the papers P stacked on the paper feed tray 21 is automatically detected by a paper size detector (not shown in the drawings) provided at the paper feed tray 21.

As described above, the opening 2*c* is opened at a vertically-middle portion of the left-side panel 2*b* of the housing 2, and a scraper roller 23 attached to a driven shaft 24 (see FIG. 2) is disposed above the paper feed tray 21 and near the opening 2*c*. The driven shaft 24 can be passively rotated by an after-described drive shaft 27 (see FIG. 2).

A pick-up roller 25 and after-described elastic rollers 26 are attached to the drive shaft 27 coaxially at a position near the scraper roller 23 and on a downstream side of the scraper roller 23. The elastic rollers 26 are driven rotationally together with the drive shaft 27. A separation plate 28 is provided fixedly beneath the pick-up roller 25 so as to be opposing to the pick-up roller 25.

As shown in FIG. 2, a pair of an upper guide plate 29 and a lower guide plate 30, and a pair of paper transfer rollers R are disposed, in this order along the paper feed path RS, on a downstream side of the pick-up roller 25 and the elastic rollers 26 in the housing 2. A space K is formed between the upper guide plate 29 and the lower guide plate 30, and the space K forms the paper feed path RS (paper transfer path). The pair of paper transfer rollers R transfers a paper P by nipping the paper P therebetween and rotating. The upper guide plate 29 and the lower guide plate 30 are disposed at a border between the opening 2*c* and the inside of the housing 2. Most of noises generated in the housing 2 by an image forming process, a paper transfer process and so on leak out to the outside of the housing 2 through the opening 2*c*. With respect to other portions of the housing 2, noises are prevented or restricted from leaking out by reducing a gap between outer panels of the housing 2 or by narrowing a gap between outer panels of the housing 2 or by eliminating such a gap. However, the space K cannot be eliminated, because it is essential to form the paper feed path RS (paper transfer path). Since it is enough to form the paper transfer path of papers P, the upper guide plate 29 and the lower guide plate 30 may be jointed with the housing 2 or other components of the image forming apparatus 1 by their own portion that don't form the paper transfer path (e.g. each upstream edge of the upper guide plate 29 and the lower guide plate 30).

The above-described scraper roller 23 and the pick-up roller 25 together function as paper feed rollers that feed papers P. In the present embodiment, when feeding papers P, high speed paper feeding can be achieved reliably by the two paper feed rollers that are configured of the scraper roller 23 that draws some of upper papers P stacked on the paper feed tray 21 and the pick-up roller 25 that separates the drawn papers P sheet by sheet at a position between the pick-up roller 25 and the separation plate 28.

Figure 3:
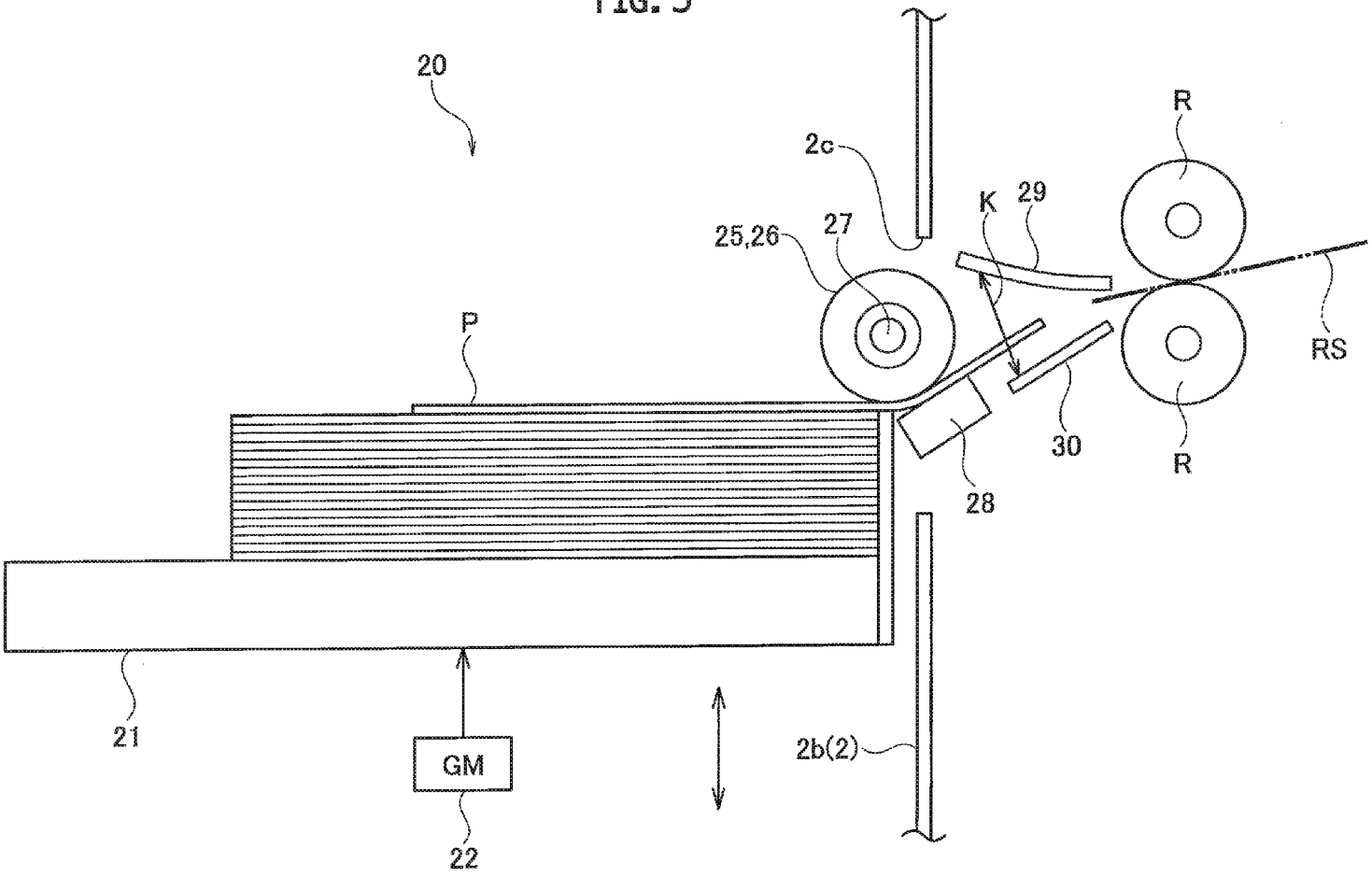
FIG. 3 is a front view of an modified example of the paper feed device.

However, in a modified example shown in FIG. 3, the outer paper feeder (paper feed device) 20 is modified so that a paper feed roller is configured of only the pick-up roller 25. According to this modified example, it is possible to feed upper papers P stacked on the paper feed tray 21 sheet by sheet by the pick-up roller and the separation plate 28. Note that the elastic rollers 26 are attached to the drive shaft 27 coaxially in this modified example, similarly to the embodiment shown in FIG. 2.

Descriptions of the embodiment shown in FIGS. 1 and 2 will be continued. When the paper feed tray 21 is moved upward and the uppermost paper P of the papers P stacked on the paper feed tray 21 reaches a paper feed position, the scraper roller 23 contacts with (is pressed onto) the uppermost paper P whole rotating, and thereby some of the upper papers P are drawn forward.

Subsequently, the papers P drawn out by the scraper roller 23 is separated sheet by sheet while they are transferred thorough a nipping position between the pick-up roller 25 and the separation plate 28. Each of the separated papers P is fed downstream to the paper feed path RS along the paper transfer direction TD set within the housing 2.

During this process, it is an important configuration to attach the pick-up roller 25 and the elastic roller 26 to the drive shaft 27 coaxially. This configuration will be described late in detail.

A pair of registry rollers Re is disposed on an upstream end of the normal path RC connected with each downstream end of the paper feed paths RS from the internal paper feeder 10 and the outer paper feeder 20 and with each downstream end of the switchback paths RR. While rotations of the pair of registry rollers Re are temporarily stopped and a leading edge of the paper P transferred from the paper feed paths RS or the switchback paths RR is contacted to a nipping position between the registry rollers Re to form a slack on the paper P. By this process, the paper P is oriented correctly, and then the paper P is fed downstream without being fed obliquely by starting rotations of the registry rollers Re at an adequate timing.

The platen belt section 50 and the inkjet print unit 55 are disposed at almost the center portion in the housing 2 so as to be opposing to each other with the normal path RC interposed therebetween. The inkjet print unit 55 is disposed above the platen belt section 50.

The platen belt section 50 sends the paper(s) transferred from the pair of registry rollers Re to a downstream section of the normal path RC at constant paper transfer speed while air-suctioning the paper P onto a endless belt 51 that can be circularly driven.

The inkjet print unit 55 is provided with line-type inkjet heads 56 that eject ink droplets of cyan (C), black (K), magenta (M) and yellow (Y) to print multicolor images on the paper P on the endless belt 51 based on image information by using the inkjet heads 56.

The paper ejector 60 is provided at an upper portion of the left-side panel 2*b* of the housing 2. Papers P printed by the inkjet print unit 55 are ejected onto an upper face 61*a* of a paper ejection tray 61 of the paper ejector 60, and thereby the ejected papers P are stacked on the paper ejection tray 61. The paper ejection tray 61 is disposed at a downstream end of the paper ejection path RD.

The paper switchback section 65 is also provided at the upper portion of the left-side panel 2*b* of the housing 2. A paper P on whose one side images have already been printed by the inkjet print unit 55 is transferred through the loop-shaped normal path RC and then introduced to the switchback path RR. The paper P is temporarily held at a switchback guide 61*b* provided on a side of a lower face of the paper ejection tray 61. Subsequently, the paper P is draw out from the switchback paths RR with its leading edge is exchanged, and then the paper P is turned over by the loop-shaped path(s). The turned-over paper P is transferred to the inkjet print unit 55 again through the pair of registry rollers Re, and then images are printed on another side of the paper P by the inkjet print, unit 55. In this manner, duplex printing is done.

The controller 70 is disposed at a proper location in the housing 2. The controller 70 totally controls the image forming apparatus 1. The controller 70 includes a CPU, a ROM, a RAM, a counter, a timer and so on therein.

(Paper Feed Device According to First Embodiment)

Hereinafter, the paper feed device according to a first embodiment will be described with reference to FIG. 4A and FIG. 4B.

Figure 4A:
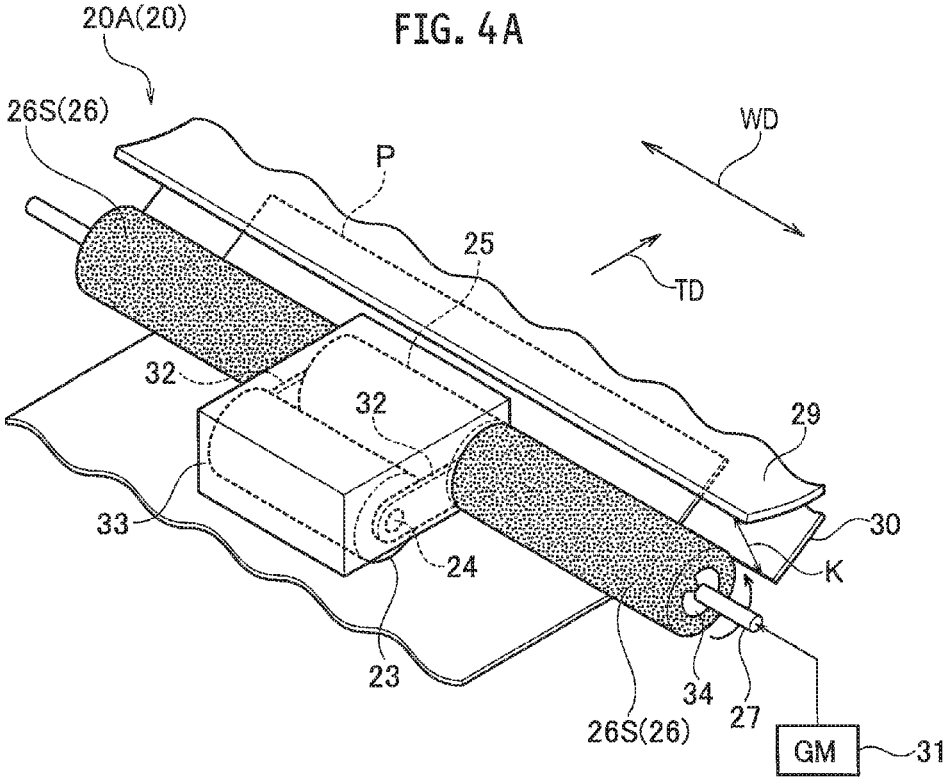
FIG. 4A is a perspective view of a paper feed device according to a first embodiment.
Figure 4B:
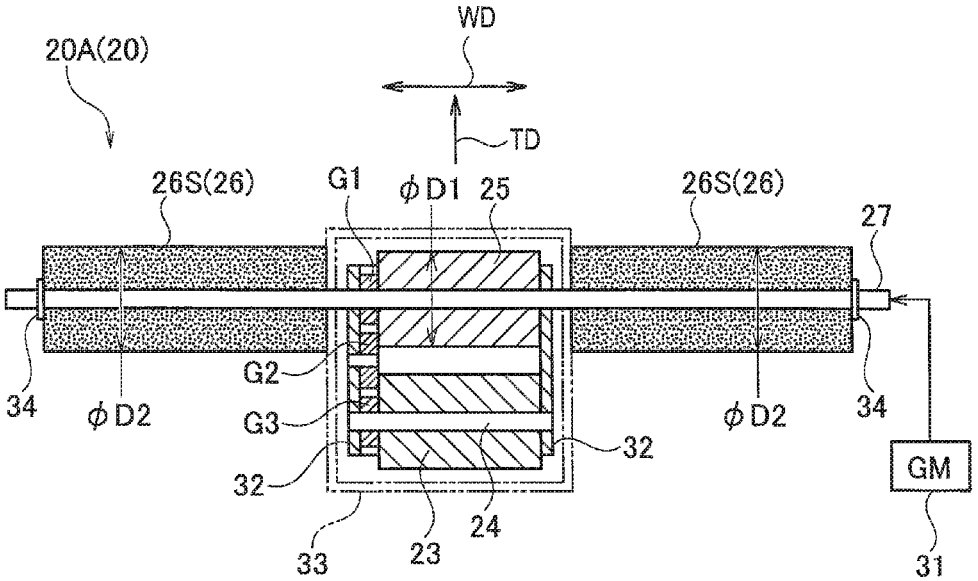
FIG. 4B is a plan view of the paper feed device according to the first embodiment.

As shown in FIG. 4A and FIG. 4B, the paper feed device 20A (20) according to the present embodiment is configured as the outer paper feeder 20 disposed near the opening 2*c* formed on the left-side panel 2*b* of the housing 2 (also see FIG. 1 and FIG. 2).

The scraper roller 23 that functions as the paper feed roller is attached to the short driven shaft 24 extended along a paper width direction WD perpendicular to the paper transfer direction TD (paper feed direction).

In addition, the pick-up roller 25 is attached to almost the center of the long drive shaft 27 extended along the paper width direction WD. The pick-up roller 25 functions as the paper feed roller, and is disposed on a downstream side of the scraper roller 23 so as to be opposing to the scraper roller 23.

The long drive shaft 27 is connected with a geared motor 31 that is a rotational drive source, and can be rotated by the geared motor 31 in a counter-clockwise direction (in FIG. 4A) that is the paper feed direction of papers P.

A side end of the scraper roller 23 and a side end of the pick-up roller 25 are coupled with each other by an arm 32, and, similarly, another side end of the scraper roller 23 and another side end of the pick-up roller 25 are coupled with each other by another arm 32. The driven shaft 24 and the drive shaft 27 are coupled with the pair of arms 32.

On a side of one of the arms 32, a gear set including gears G1, G2 and G3 is provided, and the gear G1 is fixed with the drive shaft 27. Rotations of the drive shaft 27 is transmitted to the driven shaft 24 through the gear set, so that the scraper roller 23 and the pick-up roller 25 can be rotated in the paper feed direction (counter-clockwise direction) together with each other to feed papers P.

The scraper roller 23 and the pick-up roller 25 are covered by a roller cover 33 whose bottom is opened.

The upper guide plate 29 and the lower guide plate 30 are disposed on a downstream side of the pick-up roller 25 along the paper transfer direction TD so as to be viewed through the opening 2*c* formed on the left-side panel 2*b* of the housing 2.

Each of the upper guide plate 29 and the lower guide plate 30 is made longer than a width of a maximum-size paper P along the paper width direction WD.

The space K is formed along the paper width direction WD between the upper guide plate 29 and the lower guide plate 30 so as to guide a paper P transferred into the space K from the pick-up roller 25. The space K is communicated with the opening 2*c* formed on the left-side panel 2*b* of the housing 2.

The elastic rollers 26 formed long along the axial direction of the drive shaft 27 are attached symmetrically to the drive shaft 27 on either side of the roller cover 33 that covers the pick-up roller 25 attached to almost the center of the drive shaft 27 along its longitudinal direction.

The elastic rollers 26 are prevented from dropping off from the drive shaft 27 by attaching E-washers 34 to respective ends of the drive shaft 27.

The elastic rollers 26 are main components of the paper feed device 20A according to the present embodiment, and each of them is made from elastically deformable porous foamed material having an open-cell structure. For example, each of the elastic rollers 26 is made as a sponge roller 26S made from foamed rubber, urethane foam and so on.

Each of the sponge rollers 26S is made from the elastically deformable foamed material such as EPDM (ethylene propylene diene monomer/ethylene propylene rubber), polyethylene, butyl rubber, and silicone rubber.

The first reason for using the sponge rollers 26S is that it becomes possible to prevent noises generated in the housing 2 from leaking out through the opening 2*c* by covering the space K formed between the upper guide plate 29 and the lower guide plate 30 on a downstream side from the pick-up roller (paper feed roller) 25 by use of the sponge rollers 26S formed long along the space K.

The sponge rollers 26S formed long can absorb the noises due to noise absorption characteristics of the above-described elastically deformable porous foamed material having an open-cell structure. Therefore, quietness (noise reduction) performance of the image forming apparatus 1 can be improved.

The second reason for using the sponge rollers 26S is that the sponge rollers 26S can function as paper pressing rollers that flatten a warped paper P while feeding the paper P by the scraper roller 23 and the pick-up roller 25. Since the sponge rollers 26S are rotated coaxially with the pick-up roller 25, the sponge rollers 26S don't generate frictions when transferring the paper P and hardly generate crinkles on the paper.

Note that, although not shown in FIG. 4A and FIG. 4B precisely, each diameter ϕD2 of the sponge rollers 26S is made slightly smaller than a diameter ϕD1 of the pick-up roller 25. Therefore, the warped paper P is pressed to be flattened while being fed, and can be prevented from crinkling and being fed obliquely. As a result, paper feed performance can be improved more by this configuration than a case where a paper P is fed only by the scraper roller 23 and the pick-up roller 25 (without the sponge rollers 26S), or only by the pick-up roller 25 (without the scraper roller 23 and the sponge rollers 26S).

In this configuration, the diameter ϕD1 of the pick-up roller 25 is set to almost 60 mm, and diameter ϕD2 of each of the sponge rollers 26S is set to almost 56 mm to 58 mm, for example.

With respect to the configuration where the diameter ϕD2 of each of the sponge rollers 26S is made slightly smaller than the diameter ϕD1 of the pick-up roller 25, additional explanations will be made below. While papers P are separated sheet by sheet at a separation position between the pick-up roller 25 and the separation plate 28, distortion may be generated temporarily on a paper P near the separation position. If the diameter ϕD2 of each of the sponge rollers 26S is equal-to or made larger-than the diameter ϕD1 of the pick-up roller 25, the sponge rollers 26S may collapse the distortion of the paper P. As the result, the collapsed distortion may become crinkles, or may cause oblique feeding.

According to the configuration where the diameter ϕD2 of each of the sponge rollers 26S is made slightly smaller than the diameter ϕD1 of the pick-up roller 25, even if the distortion may be generated temporarily on a paper P near the separation position while papers P are separated sheet by sheet at the separation position between the pick-up roller 25 and the separation plate 28, a gap is formed beneath the sponge roller(s) 26S so as not to collapse the distortion. Therefore, the distortion may disappear when the paper P is fed further, and crinkles and oblique feeding can be prevented.

The third reason for using the sponge rollers 26S is that the sponge roller(s) 26S has elastic deformability. Therefore, the sponge rollers 26S bring jammed-paper removability for easily removing a jammed paper (not shown in the drawings) from any cause when feeding papers.

When removing the jammed paper, a user or a service person can easily deform the sponge rollers 26S by his/her fingers, and thereby can remove the jammed paper easily.

Next, first and second modified examples of the paper feed device 20A according to the above-described first embodiment will be described with reference to FIG. 5A to FIG. 6B.

First Modified Example of First Embodiment

Figure 5A:
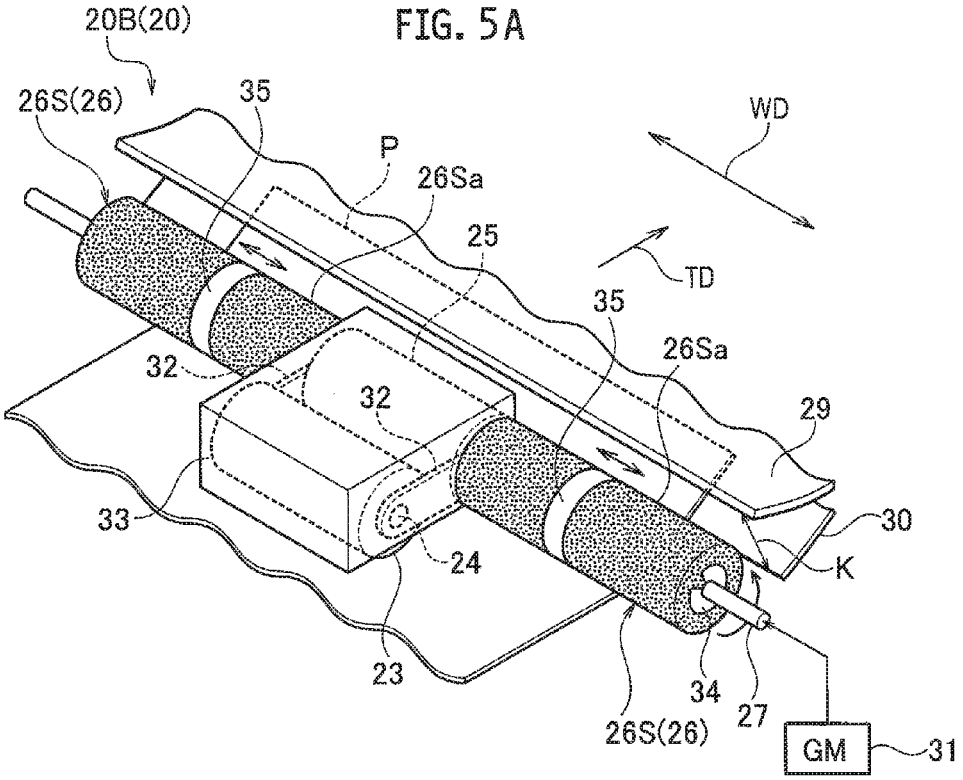
FIG. 5A is a perspective view of a first modified example of the paper feed device according to the first embodiment.
Figure 5B:
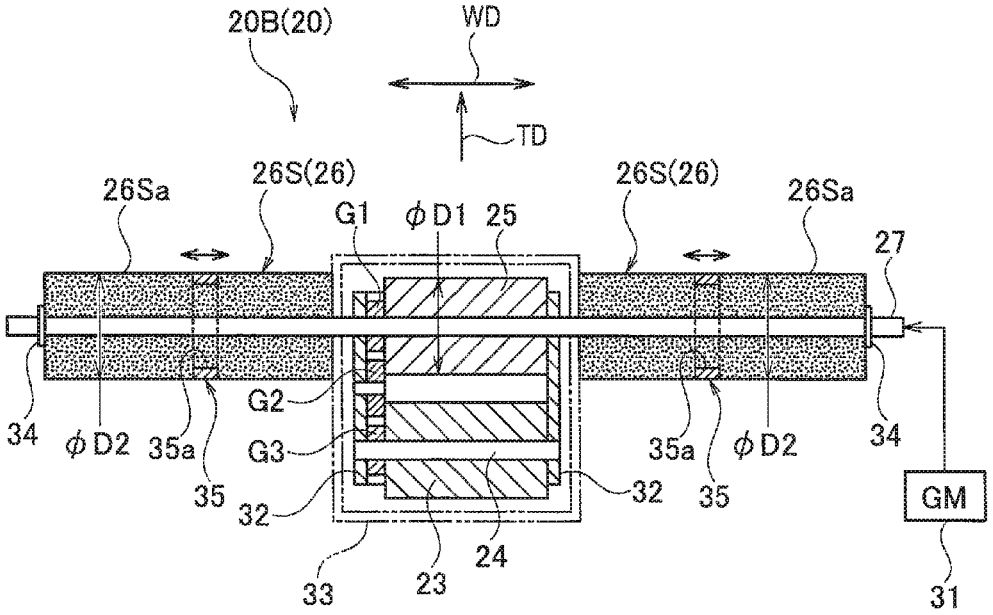
FIG. 5B is a plan view of the first modified example.
Figure 6:
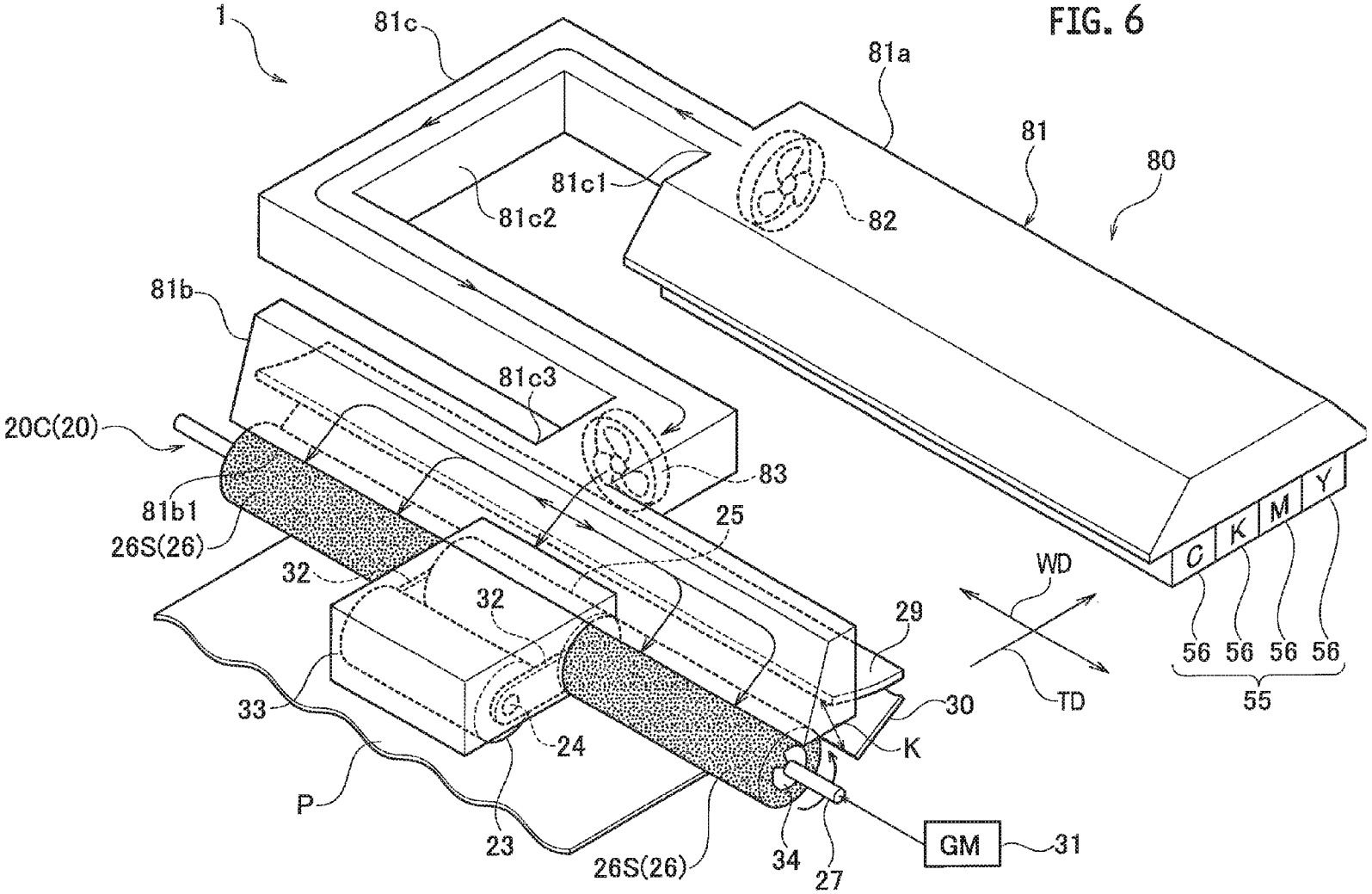
FIG. 6 is a perspective view of a second modified example of the paper feed device according to the first embodiment.

As shown in FIG. 5A and FIG. 5B, the paper feed device 20B (20) according to the first modified example has some different configurations from those of the paper feed device 20A (20) according to the above-described first embodiment. Components in the present modified example identical or equivalent to those in the first embodiment will be labelled with identical reference numerals, and thereby their redundant descriptions will be omitted.

The paper feed device 20B (20) according to the present modified example is configured as the outer paper feeder 20 of the image forming apparatus 1 (FIG. 1), similarly to that in the above-described first embodiment. Also in the present modified example, the sponge rollers 26S formed long are attached to the drive shaft 27 on either side of the pick-up roller 25 covered with the roller cover 33.

The sponge rollers 26S in the paper feed device 20B are different from those in the paper feed device 20A according to the above-described first embodiment in that a paper pressing roller 35 formed from resin material to have a narrow width along the paper width direction WD and thereby have a ring-shape is attached on each outer circumferential surface 26Sa of the sponge rollers 26S.

Since the paper pressing rollers 35 are formed as rigid bodies from resign material, even a warped thick paper P can be flattened surely by the paper pressing rollers 35.

Each diameter of the paper pressing rollers 35 is made slightly smaller than the diameter ϕD1 of the pick-up roller 25, and is made almost equal to each diameter ϕD2 of the sponge rollers 26S. In addition, each of the paper pressing rollers 35 is provided with a through hole 35*a* whose inner diameter is smaller than the diameter ϕD2 of the sponge rollers 26S.

The paper pressing roller 35 is attached on the outer circumferential surface 26Sa by inserting the sponge roller 26 into the through hole 35*a* while elastically deforming the sponge roller 26, so that the paper pressing roller 35 is slidable in the axial direction of the drive shaft 27 so as to change its position according to a width of papers P in the paper width direction WD. Therefore, a warped thick paper P can be flattened surely according to its paper size, even if the width of papers P in the paper width direction WD varies.

Second Modified Example of First Embodiment

As shown in FIG. 6A and FIG. 6B, the paper feed device 20C (20) according to the second modified example has some different configurations from those of the paper feed device 20A (20) according to the above-described first embodiment. Components in the present modified example identical or equivalent to those in the first embodiment will be labelled with identical reference numerals, and thereby their redundant descriptions will be omitted.

The paper feed device 20C (20) according to the present modified example is configured as the outer paper feeder 20 of the image forming apparatus 1 (FIG. 1), similarly to that in the above-described first embodiment. Also in the present modified example, the sponge rollers 26S formed as the elastic rollers 26 and made from the formed material are attached to the drive shaft 27 on either side of the pick-up roller 25 covered with the roller cover 33.

The paper feed device 20C are different from the paper feed device 20A according to the above-described first embodiment in that the paper feed device 20C is provided with a hot-air blower 80. The hot-air blower 80 warms the elastic rollers 26 made from the foamed material by blowing hot air that is warmed by exhaust heat generated in the image forming apparatus 1.

The hot-air blower 80 includes a duct 81, a first blower fan 82, and a second blower fan 83 to blow hot air warmed by use of exhaust heat generated at the inkjet print unit 55 toward the paper feed device 20C The duct 81 for blowing hot air includes a head duct portion 81*a*, a paper feeder duct portion 81*b*, and a connecting duct portion 81*c*. The head duct portion 81*a* covers the line-type inkjet heads 56 provided in the inkjet print unit 55. The paper feeder duct portion 81*b* covers the roller cover 33 and the sponge rollers 26. The connecting duct portion 81*c* connects the head duct portion 81*a* with the paper feeder duct portion 81*b*. The head duct portion 81*a*, the paper feeder duct portion 81*b* and the connecting duct portion 81*c* are made integrally by welding metal sheet materials.

One end 81*c*1 of the connecting duct portion 81*c* is connected with a left-side face of the head duct portion 81*a*. An intermediate portion 81*c*2 of the connecting duct portion 81*c* has a U-shape. Another end 81*c*3 of the connecting duct portion 81*c* is connected with almost the center of the paper feeder duct portion 81*b* in the paper width direction WD.

The first blower fan 82 is disposed in the head duct portion 81*a* near a connecting port with the one end 81*c*1.

The second blower fan 83 is disposed in the other end 81*c*3 and near another connecting port with the paper feeder duct portion 81*b*.

When the hot-air blower 80 is configured as described above, air around the inkjet heads 56 is warmed in the head duct portion 81*a* by exhaust heat generated from the inkjet heads 56 that are heated when printing is done.

The air warmed in the head duct portion 81*a* is blown, as hot (warm) air, into the connecting duct portion 81*c* by the first blower fan 82. The hot air is further blown into the paper feeder duct portion 81*b* through the connecting duct portion 81*c* by the second blower fan 83.

Then, the hot air is blown onto the pick-up roller 25 and the sponge rollers 26S from a blower port 81*b*1 opened along the paper width direction WD on a bottom of the paper feeder duct portion 81*b*.

Temperature of the hot air is almost 60° C. Since the pick-up roller 25 and the sponge rollers 26S are warmed by the hot air without any problem, the pick-up roller 25 and the sponge rollers 26S can be prevented from hardening. In addition, it becomes possible to get superior and stable quietness due to characteristics of noise-absorption sponge. Especially, the sponge rollers 26S can be prevented from hardening effectively in winter when room temperature becomes low.

Note that the hot-air blower 80 can be applied to the paper feed device 20B according to the first modified example described with reference to FIG. 5A and FIG. 5B. Also in this case, it is possible to blow the hot air warmed by exhaust heat generated in the image forming apparatus 1 onto the pick-up roller 25 and the sponge rollers 26S.

In addition, the exhaust heat generated by the line-type inkjet head 56 is used in the present modified example. However, the exhaust heat to be used is not limited to this. In a case where the image forming apparatus 1 is equipped with a dryer (not shown in the drawings) for drying images printed on a paper P, exhaust heat generated from the dryer may be used for warming the pick-up roller 25 and the sponge rollers 26S (the elastic rollers 26).

(Paper Feed Device According to Second Embodiment)

Next, a paper feed device according to a second embodiment will be described with reference to FIG. 7A and FIG. 7B.

Figure 7A:
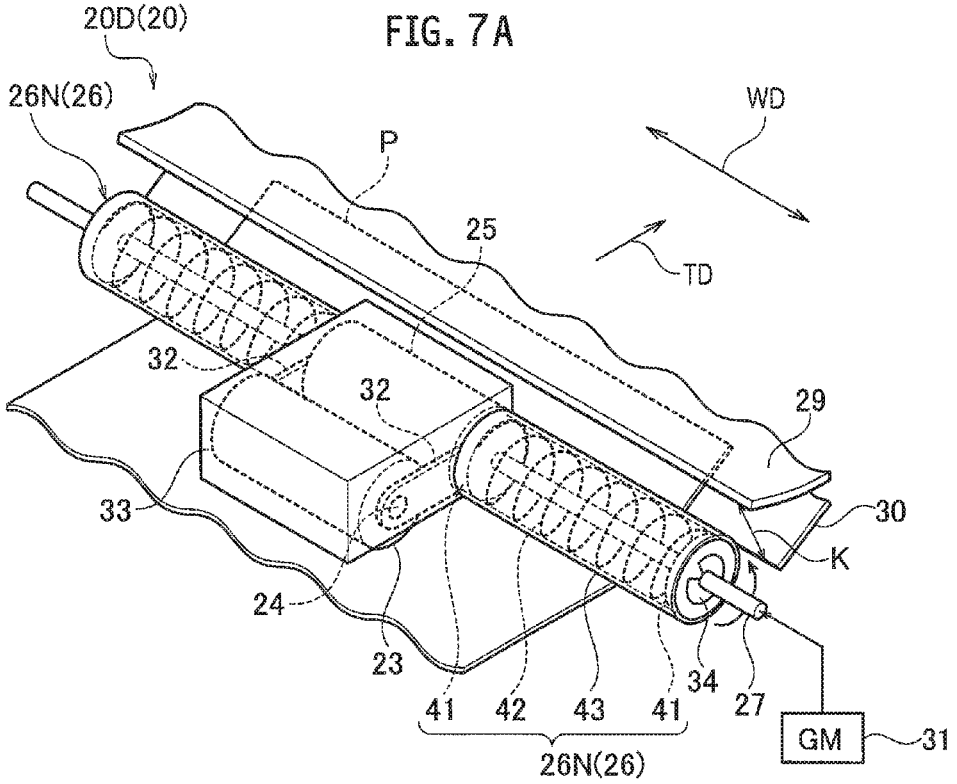
FIG. 7A is a perspective view of a paper feed device according to a second embodiment.
Figure 7B:
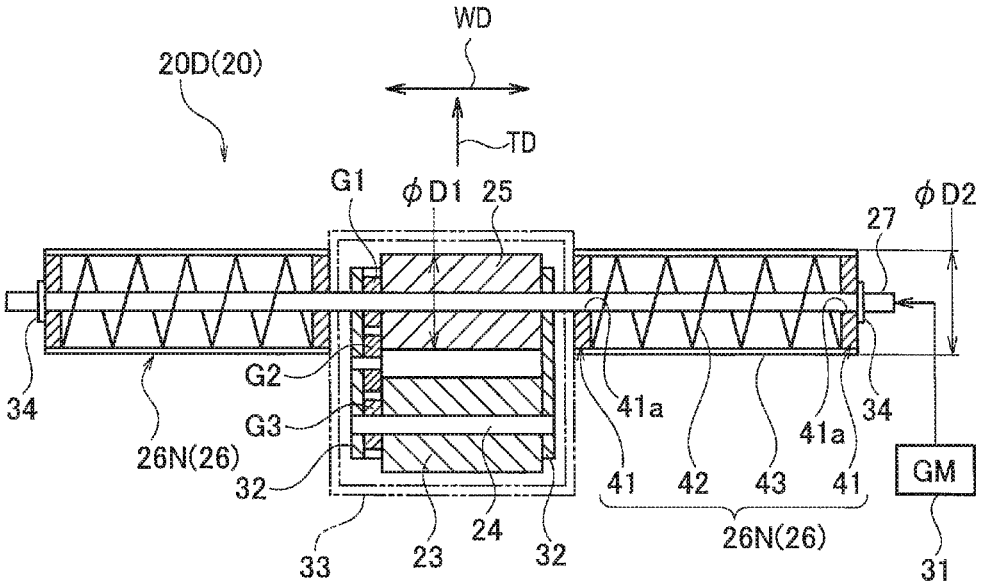
FIG. 7B is a plan view of the paper feed device according to the second embodiment.

As shown in FIG. 7A and FIG. 7B, the paper feed device 20D (20) according to the second embodiment has some different configurations from those of the paper feed device 20A (20) according to the above-described first embodiment. Components in the present modified example identical or equivalent to those in the first embodiment will be labelled with identical reference numerals, and thereby their redundant descriptions will be omitted.

The paper feed device 20D (20) according to the present embodiment is configured as the outer paper feeder 20 of the image forming apparatus 1 (FIG. 1), similarly to that in the above-described first embodiment.

In the paper feed device 20D (20) in the present embodiment, cloth-wrapped elastic rollers 26N are used as the elastic roller 26 instead of the sponge rollers 26S in the first embodiment.

Also the cloth-wrapped elastic rollers 26N are formed long along the axial direction of the drive shaft 27, and attached symmetrically and coaxially to the drive shaft 27 on either side of the pick-up roller 25 covered with the roller cover 33.

Each of the cloth-wrapped elastic rollers 26N includes a pair of ring-shaped circular plates 41, a compression spring 42, and a hollow cylindrical cloth member 43. Each diameter of the ring-shaped circular plates 41 is made slightly smaller than the diameter D1 of the pick-up roller 25. A through hole 41*a* is formed at the center of each of the ring-shaped circular plates 41. Each inner diameter of the through holes 41*a* is made equal to a shaft diameter of the drive shaft 27. The compression spring 42 has an outer diameter almost equal to the diameter of the ring-shaped circular plates 41, and interposed between the pair of ring-shaped circular plates 41. The hollow cylindrical cloth member 43 is formed long in the axial direction of the drive shaft 27 so as to cover the pair of ring-shaped circular plates 41 and the compression ring 42.

When attaching the cloth-wrapped elastic rollers 26N to respective ends of the drive shaft 27, the compression spring 42 is interposed between the pair of ring-shaped circular plates 41 distanced on the drive shaft 27, and the pair of ring-shaped circular plates 41 and the compression spring 42 is covered by the hollow cylindrical cloth member 43 formed long in the in the axial direction of the drive shaft 27. In this manner, the cloth-wrapped elastic rollers 26N are formed.

According to this configuration, each of the cloth-wrapped elastic rollers 26N is expanded in the axial direction of the drive shaft 27 due to an elastic restoring force of the compression spring 42 to have a cylindrical shape, and then E-washers 34 are attached to respective ends of the drive shaft 27 to prevent the cloth-wrapped elastic rollers 26N from dropping off from the drive shaft 27.

The first reason for using the cloth-wrapped elastic rollers 26N is that it becomes possible to prevent noises generated in the housing 2 from leaking out through the opening 2*c* by covering the space K formed between the upper guide plate 29 and the lower guide plate 30 on a downstream side from the pick-up roller (paper feed roller) 25 by use of the cloth-wrapped elastic rollers 26N formed long along the space K.

The second reason for using the sponge rollers 26S is, similarly to the first embodiment, that the cloth-wrapped elastic rollers 26N can function as paper pressing rollers that flatten a warped paper P while feeding the paper P by the scraper roller 23 and the pick-up roller 25.

Note that, although not shown in FIG. 7A and FIG. 7B precisely, each diameter ϕD2 of the cloth-wrapped elastic rollers 26N is made slightly smaller than the diameter ϕD1 of the pick-up roller 25. Therefore, the warped paper P is pressed to be flattened while being fed, and can be prevented from crinkling and being fed obliquely. As a result, paper feed performance can be improved more by this configuration than a case where a paper P is fed only by the scraper roller 23 and the pick-up roller 25 (without the cloth-wrapped elastic rollers 26N), or only by the pick-up roller 25 (without the scraper roller 23 and the cloth-wrapped elastic rollers 26N).

In this configuration, the diameter ϕD1 of the pick-up roller 25 is set to almost 60 mm, and diameter ϕD2 of each of the cloth-wrapped elastic rollers 26N is set to almost 56 mm to 58 mm, for example.

The third reason for using the sponge rollers 26S is, similarly to the first embodiment, that the cloth-wrapped elastic roller(s) 26N has elastic deformability. Therefore, the cloth-wrapped elastic rollers 26N bring jammed-paper removability for easily removing a jammed paper (not shown in the drawings) from any cause when feeding papers due to some reason.

When removing the jammed paper, a user or a service person can easily deform the cloth-wrapped elastic rollers 26N by his/her fingers, and thereby can remove the jammed paper easily.

Next, a modified example of the paper feed device 20D according to the above-described second embodiment will be described with reference to FIG. 8A and FIG. 8B.

Modified Example of Second Embodiment

Figure 8A:
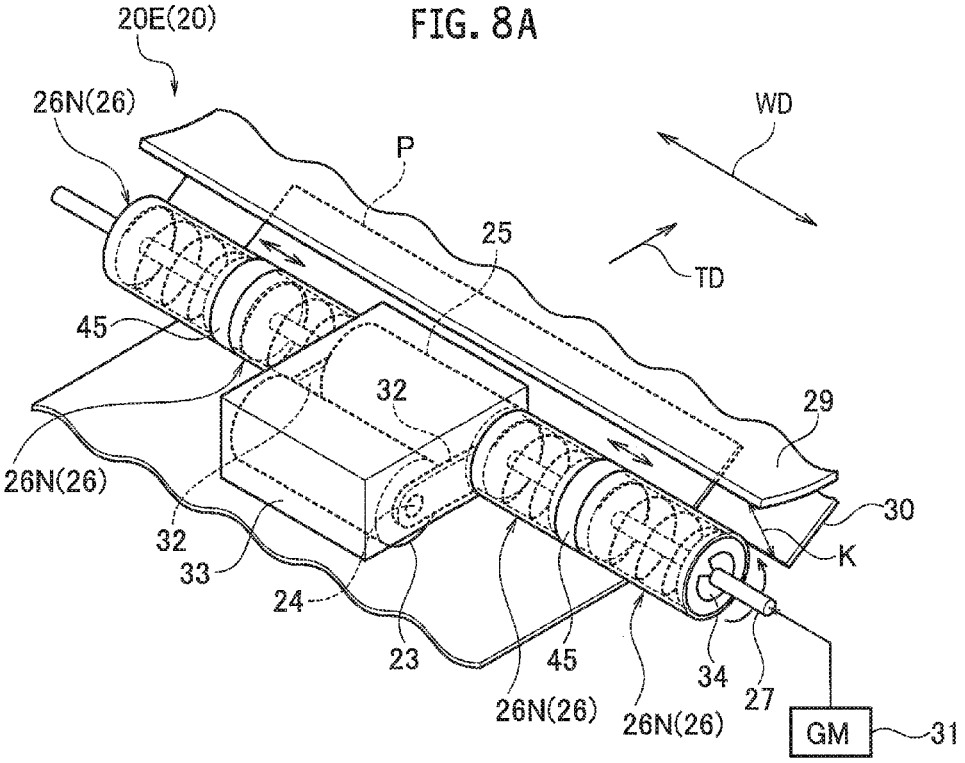
FIG. 8A is a perspective view of a modified example of the paper feed device according to the second embodiment.
Figure 8B:
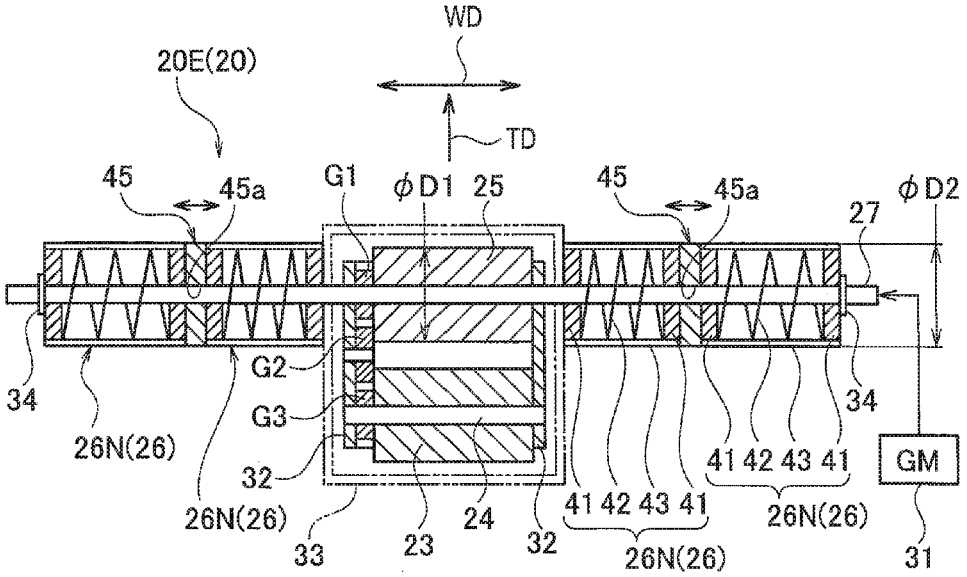
FIG. 8B is a plan view of the modified example.

As shown in FIG. 8A and FIG. 8B, the paper feed device 20E (20) according to the present modified example has some different configurations from those of the paper feed device 20D (20) according to the above-described second embodiment. Components in the present modified example identical or equivalent to those in the second (or first) embodiment will be labelled with identical reference numerals, and thereby their redundant descriptions will be omitted.

The paper feed device 20E (20) according to the present modified example is configured as the outer paper feeder 20 of the image forming apparatus 1 (FIG. 1), similarly to that in the above-described second (and first) embodiment.

The cloth-wrapped elastic rollers 26N in the paper feed device 20E are different from those in the paper feed device 20D according to the above-described second embodiment in that two sets of one cloth-wrapped elastic roller 26N, a paper pressing roller 45 and another cloth-wrapped elastic roller 26N are attached symmetrically to the drive shaft 27 on either side of the pick-up roller 25 covered with the roller cover 33.

The paper pressing rollers 45 in the present modified example are different from the paper pressing rollers 35 in the first modified example of the first embodiment. Each of the paper pressing rollers 45 is attached to the drive shaft 27 so as to be interposed between the one and other cloth-wrapped elastic rollers 26N.

Each of the paper pressing rollers 45 is formed from resign material and has a ring-shape. Each of the paper pressing rollers 45 has a narrow width in the paper width direction WD. Each diameter of the paper pressing rollers 45 is made slightly smaller than the diameter ϕD1 of the pick-up roller 25, and is made almost equal to each diameter ϕD2 of the cloth-wrapped elastic rollers 26N. A through hole 45*a* is formed at the center of each of the paper pressing rollers 45. Each inner diameter of the through holes 45*a* is made equal to the shaft diameter of the drive shaft 27.

Since the paper pressing rollers 45 are formed as rigid bodies from resign material, even a warped thick paper P can be flattened surely by the paper pressing rollers 45.

The paper pressing roller 45 is interposed between the one and other cloth-Tapped elastic rollers 26N each having the compression spring 42. By elastically deforming the respective compression springs 42 on both sides of the paper pressing roller 45, the paper pressing roller 45 can be moved in the axial direction of the drive shaft 27 so as to change its position according to a width of papers P in the paper width direction WD. Therefore, a warped thick paper P can be flattened surely according to its paper size, even if the width of papers P in the paper width direction WD varies.

The present invention is not limited to the above-mentioned embodiment and modified examples, and it is possible to embody the present invention by modifying its components in a range that does not depart from the scope thereof. Further, it is possible to form various kinds of inventions by appropriately combining a plurality of components disclosed in the above-mentioned embodiment and modified examples. For example, it may be possible to omit several components from all of the components shown in the above-mentioned embodiment.

The present application claims the benefits of priorities under 35 U.S.C. §119 to Japanese Patent Application No. 2015-011990, filed on Jan. 26, 2015, and Japanese Patent. Application No. 2015-163358, filed on Aug. 21, 2015, the entire contents of which are incorporated herein by reference.

What is claimed is:

1. A paper feed device for an image forming apparatus that is disposed near an opening formed on a portion of a housing of the apparatus, the device comprising:

a paper feed tray on which papers can be stacked;

an upper guide plate and a lower guide plate that are disposed at a border between the opening and an inside of the housing, and forms a paper transfer path therebetween;

a drive shaft that is disposed on an upstream side from the upper guide plate and the lower guide plate so as to extends along a paper width direction perpendicular to the paper transfer direction, and is rotated, by a drive source therefor, in a rotational direction for feeding the papers;

a paper feed roller that is attached to the drive shaft, and separates a paper from the papers stacked on the paper feed tray to feed the paper to the paper feed path formed between the upper guide plate and the lower guide plate; and a pair of elastic rollers that are attached to the drive shaft on either side of the paper feed roller coaxially with the paper feed roller, and formed long so as to cover a space between the upper guide plate and the lower guide plate, wherein each diameter of the elastic rollers is made slightly smaller than a diameter of the paper feed roller.

2. The paper feed device according to claim 1, wherein each of the elastic rollers is made from elastically deformable foamed material.

3. The paper feed device according to claim 2, wherein each of the elastic rollers is formed as a sponge roller made from the foamed material, a paper pressing roller that has a diameter almost equal to a diameter of the sponge roller and has rigidity for flattening a warped paper is attached to the sponge roller, and the paper pressing roller is slidable on an outer circumferential surface of the sponge roller that is elastically deformable.

4. The paper feed device according to claim 2, further comprising a hot-air blower that blows hot air warmed by exhaust heat generated in the image forming apparatus onto the elastic rollers.

5. The paper feed device according to claim 2, wherein the paper feed roller includes a scraper roller that is disposed parallel to the drive shaft to be rotatably, and draw forward some upper papers from the papers stacked on the paper feed tray, and a pick-up roller that is attached to the drive shaft, and separate an uppermost paper from the upper papers drawn by the scraper roller to feed the uppermost paper to the paper transfer path formed between the upper guide plate and the lower guide plate, wherein the pair of elastic rollers is attached to the drive shaft on either side of the pick-up roller coaxially with the pick-up roller, and each diameter of the elastic rollers is made slightly smaller than a diameter of the pick-up roller.

6. The paper feed device according to claim 1, wherein each of the elastic rollers is formed as a cloth-wrapped elastic roller that includes a pair of ring-shaped circular plates that is distanced on the drive shaft, a compression spring that is interposed between the pair of ring-shaped circular plates, and a hollow cylindrical cloth member that is formed long in the in an axial direction of the drive shaft to cover the pair of ring-shaped circular plates and the compression spring.

7. The paper feed device according to claim 6, wherein the cloth-wrapped elastic roller is disposed in a plurality on either side of the paper feed roller coaxially with the drive shaft, a paper pressing roller that has a diameter almost equal to a diameter of the cloth-wrapped elastic roller and has rigidity for flattening a warped paper is interposed between the plurality of cloth-wrapped elastic roller on either side of the paper feed roller.

* * * * *